US007380666B1

(12) United States Patent
Buckelew

(10) Patent No.: US 7,380,666 B1
(45) Date of Patent: Jun. 3, 2008

(54) GUM DISPOSAL APPARATUS

(76) Inventor: Jami J. Buckelew, 7790 Arroyo Vista Ave., Rancho Cucamonga, CA (US) 91730

( * ) Notice: Subject to any disclaimer, the term of this patent is extended or adjusted under 35 U.S.C. 154(b) by 254 days.

(21) Appl. No.: 11/283,465

(22) Filed: Nov. 21, 2005

(51) Int. Cl.
*B65D 79/00* (2006.01)

(52) U.S. Cl. ..... 206/527; 206/38; 206/800

(58) Field of Classification Search ..... 206/85, 206/86, 96, 102, 103, 104, 118, 38, 527, 800
See application file for complete search history.

(56) References Cited

U.S. PATENT DOCUMENTS 2,007,042 A 7/1935 Duckett
2,850,160 A 9/1958 Siebel et al.
3,845,858 A * 11/1974 Jenkins ..... 206/233
4,078,662 A 3/1978 Volland
D350,893 S 9/1994 Sinanis et al.
5,415,276 A * 5/1995 Welton ..... 206/104
5,725,310 A 3/1998 Kruczko
5,797,494 A 8/1998 Balling et al.
6,177,391 B1 * 1/2001 Zafar ..... 510/131
6,830,152 B2 * 12/2004 Smith ..... 206/527

* cited by examiner

*Primary Examiner*—David T Fidei

(57) ABSTRACT

A gum disposal apparatus for permitting a user to easily dispose of chewed gum includes a plurality of disposal sheets. Each of the disposal sheets is positionable around a piece of chewed gum. A cover extends around a portion of the disposal sheets to keep the disposal sheets in a stacked arrangement. A securing member secures the disposal sheets to the cover wherein individual ones of the disposal sheets may be torn away from the securing member.

4 Claims, 3 Drawing Sheets

GUM DISPOSAL APPARATUS

BACKGROUND OF THE INVENTION

1. Field of the Invention

The present invention relates to chewing gum receivers and more particularly pertains to a new chewing gum receiver for permitting a user to easily dispose of chewed gum.

2. Description of the Prior Art

The use of chewing gum receivers is known in the prior art. U.S. Pat. No. 2,850,160 describes a device for packaging various articles. Another type of chewing gum receiver is U.S. Pat. No. 2,007,042 for dispensing receivers for chewed gum.

While these devices fulfill their respective, particular objectives and requirements, the need remains for a device that has certain improved features allowing for chewed gum to be easily disposed of at the discretion of the user with the disposal sheets for disposing of the chewed gum being readily carried and concealed by the user.

SUMMARY OF THE INVENTION

The present invention meets the needs presented above by generally comprising a plurality of disposal sheets. Each of the disposal sheets is flexible and is configured to be wrapped around a piece of chewed gum. A cover extends around a portion of the disposal sheets to keep the disposal sheets in a stacked arrangement. A securing member secures the disposal sheets to the cover wherein individual ones of the disposal sheets may be torn away from the securing member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
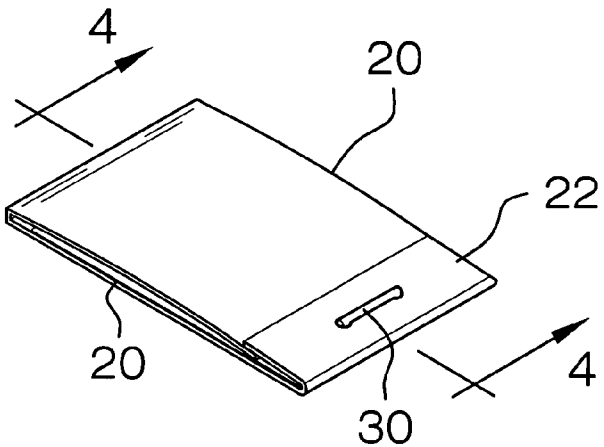
FIG. 2 is a perspective view of the present invention showing the free end of the flap portion inserted between the tab portion and the disposal sheets.
Figure 1:
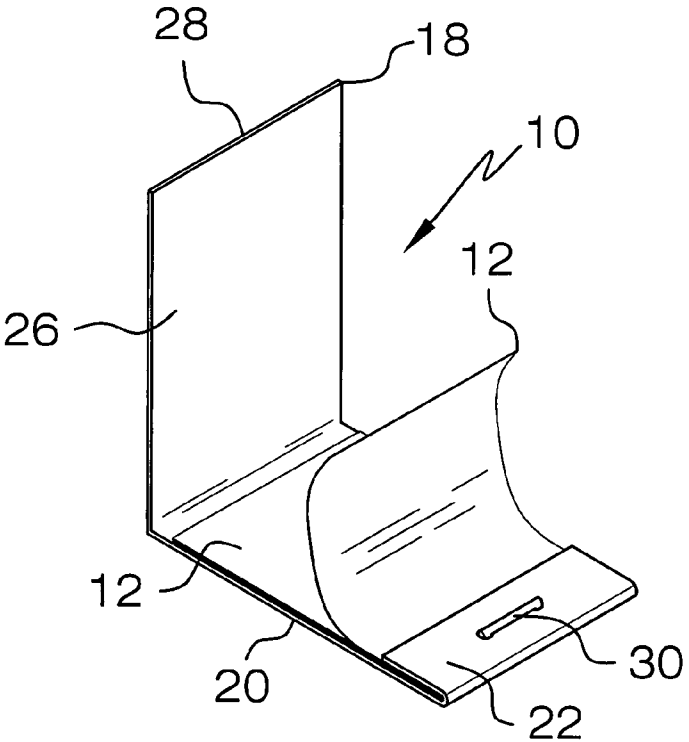
FIG. 1 is a perspective view of a gum disposal apparatus according to the present invention showing the flap portion folded away from the disposal members.
Figure 4:
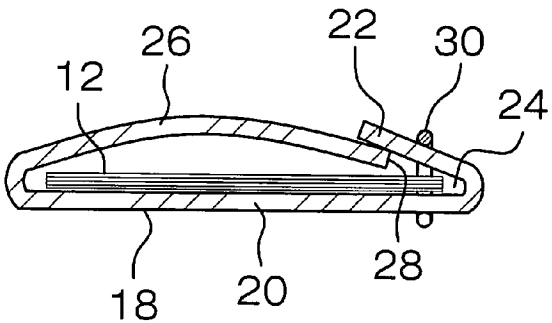
FIG. 4 is a cross-sectional view of the present invention taken along line 4-4 of FIG. 2.
Figure 5:
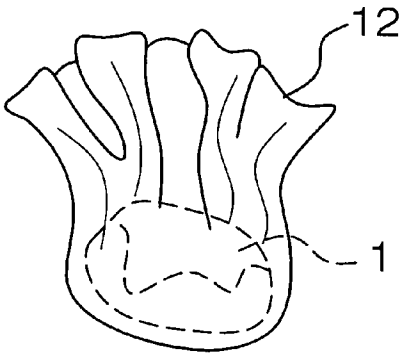
FIG. 5 is a side view of one of the disposal sheets of the present invention folded around the chewed gum.
Figure 3:
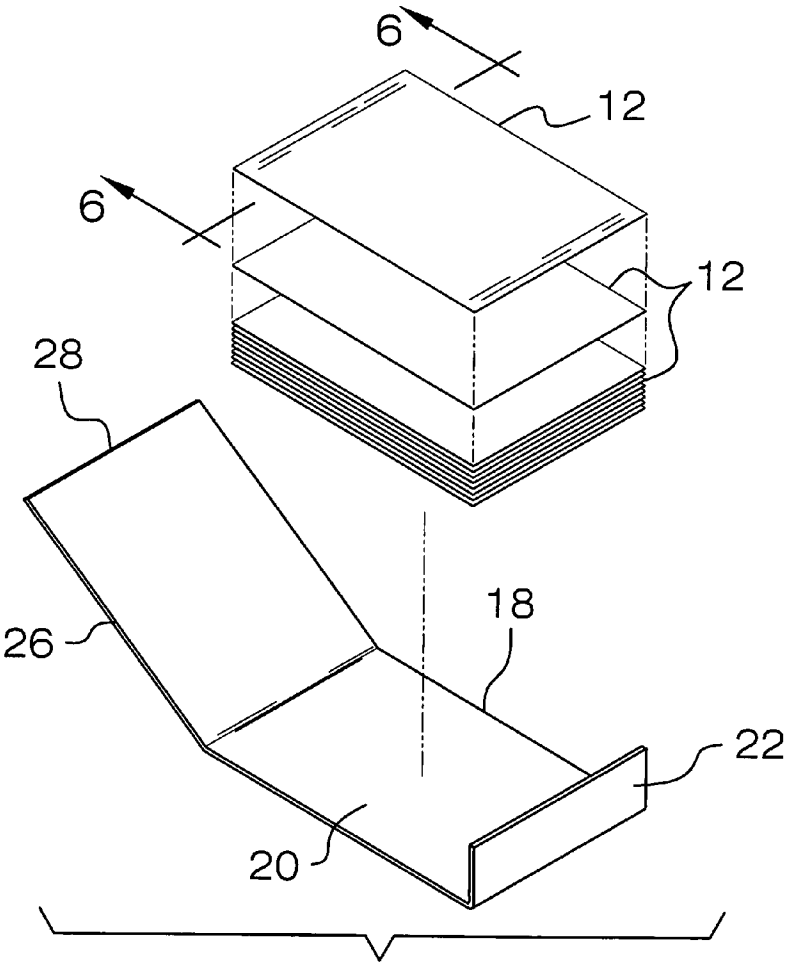
FIG. 3 is an exploded perspective view of the present invention.
Figure 6:
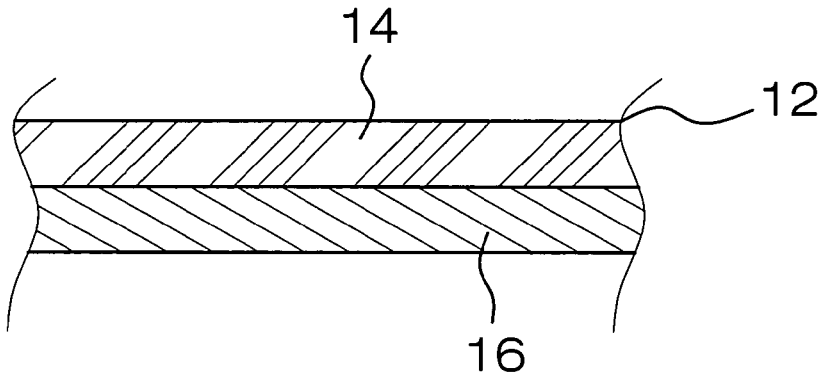
FIG. 6 is a cross-sectional view one of the disposal sheets of the present invention taken along line 6-6 of FIG. 3.

With reference now to the drawings, and in particular to FIGS. 1 through 6 thereof, a new chewing gum receiver embodying the principles and concepts of the present invention and generally designated by the reference numeral 10 will be described.

As best illustrated in FIGS. 1 through 6, the gum disposal apparatus 10 generally comprises a plurality of disposal sheets 12. Each of the disposal sheets 12 is flexible and is configured to be wrapped around a piece of chewed gum 1. Each of the disposal sheets 12 includes an absorbent layer 14 and a non-permeable layer 16. The absorbent layer 14 is configured to absorb moisture from and adhere to the chewed gum 1. The non-permeable layer 16 is substantially waterproof and configured to inhibit moisture from the chewed gum 1 from permeating a disposal sheet 12 holding the chewed gum 1. Each of the disposal sheets 12 has a length of about 2⅛ inches and a width of about 2⅛ inches.

A cover 18 extends around a portion of the disposal sheets 12 to keep the disposal sheets 12 in a stacked arrangement. The cover 18 includes a backing portion 20 and a tab portion 22 being integrally coupled to the backing portion 20. The tab portion 22 is folded back over the backing portion 20 to form a channel 24 between the backing portion 20 and the tab portion 22. The disposal sheets 12 are inserted into the channel 24 of the cover 18. The cover 18 includes a flap portion 26 integrally coupled to the backing portion 20 opposite the tab portion 22. The flap portion 26 is selectively folded back over the backing portion 20 and a free end 28 of the flap portion 26 is inserted between the tab portion 22 and the disposal sheets 12 to cover 18 the disposal sheets 12. The free end 28 of the flap portion 26 is removed from between the tab portion 22 and the disposal sheets 12 to permit access to the disposal sheets 12 extending out of the channel 24. The cover 18 has a length of about 4⅜ inches and width of about 2⅛ inches. The backing portion 20 has a length of about 2 inches and the tab portion 22 has a length of about ⅝ of an inch leaving the lap portion with a length of about 1¾ inches. A securing member 30, such as a staple, secures the disposal sheets 12 in the channel 24. The securing member 30 extends through the tab portion 22, backing portion 20 and through the disposal sheets 12 to secure the backing sheets in the channel 24 of the cover 18 wherein individual ones of the disposal sheets 12 may be torn away from the securing member 30.

In use, the user removes the free end 28 of the flap portion 26 from between the tab portion 22 and the disposal sheets 12 and folds the flap portion 26 away from the disposal sheets 12. One of the disposal sheets 12 is torn from the securing member 30 and removed from the channel 24 of the cover 18. The chewed gum 1 is placed against the absorbent layer 14 of the disposal sheet 12 removed from the cover 18 and the disposal sheet 12 is folded around the chewed gum 1. The chewed gum 1 and the disposal sheet wrapped around the chewed gum 1 are disposed of. The flap portion 26 is folded over the disposal sheets 12 secured to the cover 18 and the free end 28 of the flap portion 26 is inserted between the tab portion 22 and the disposal sheets 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gum disposal apparatus for facilitating disposal of chewed gum, said apparatus comprising:

a plurality of disposal sheets, each of said disposal sheets being flexible and being configured to be wrapped around a piece of chewed gum, each of said disposal sheets including an absorbent layer, said absorbent layer being configured to absorb moisture from and adhere to the chewed gum, each of said disposal sheets including a non-permeable layer being coupled to said absorbent layer, said non-permeable layer being substantially waterproof and configured to inhibit moisture from the chewed gum from permeating a disposal sheet holding the chewed gum;

a cover extending around a portion of said disposal sheets to keep said disposal sheets in a stacked arrangement; and a securing member securing said disposal sheets to said cover wherein individual ones of said disposal sheets may be torn away from said securing member.

2. The apparatus of claim 1, wherein said cover includes a backing portion and a tab portion being integrally coupled to said backing portion, said tab portion being folded back over said backing portion to form a channel between said backing portion and said tab portion, said disposal sheets being inserted into said channel of said cover, said securing member extending through said tab and backing portions and through said disposal sheets to secure said backing sheets in said channel.

3. The apparatus of claim 2, wherein said cover includes a flap portion being integrally coupled to said backing portion opposite said tab portion, said flap portion being selectively folded back over said backing portion and a free end of said flap portion being inserted between said tab portion and said disposal sheets to cover said disposal sheets, said free end of said flap portion being removed from between said tab portion and said disposal sheets to permit access to said disposal sheets extending out of said channel.

4. A gum disposal apparatus for facilitating disposal of chewed gum, said apparatus comprising:

a plurality of disposal sheets, each of said disposal sheets being flexible and being configured to be wrapped around a piece of chewed gum, each of said disposal sheets including an absorbent layer and a non-permeable layer, said absorbent layer being configured to absorb moisture from and adhere to the chewed gum, said non-permeable layer being substantially waterproof and configured to inhibit moisture from the chewed gum from permeating a disposal sheet holding the chewed gum;

a cover extending around a portion of said disposal sheets to keep said disposal sheets in a stacked arrangement, said cover including a backing portion and a tab portion being integrally coupled to said backing portion, said tab portion being folded back over said backing portion to form a channel between said backing portion and said tab portion, said disposal sheets being inserted into said channel of said cover, said cover including a flap portion being integrally coupled to said backing portion opposite said tab portion, said flap portion being selectively folded back over said backing portion and a free end of said flap portion being inserted between said tab portion and said disposal sheets to cover said disposal sheets, said free end of said flap portion being removed from between said tab portion and said disposal sheets to permit access to said disposal sheets extending out of said channel; and a securing member securing said disposal sheets in said channel, said securing member extending through said tab and backing portions and through said disposal sheets to secure said backing sheets in said channel of said cover wherein individual ones of said disposal sheets may be torn away from said securing member.

* * * * *